US011439880B1

(12) United States Patent
Pontrelli

(10) Patent No.: US 11,439,880 B1
(45) **Date of Patent: *Sep. 13, 2022**

(54) GAME BOARD HOLDER AND METHOD OF USE

(71) Applicant: Mike Pontrelli, Fallbrook, CA (US)

(72) Inventor: Mike Pontrelli, Fallbrook, CA (US)

(73) Assignee: John Wallace Rockett, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/683,782

(22) Filed: Mar. 1, 2022

Related U.S. Application Data

(63) Continuation of application No. 17/523,773, filed on Nov. 10, 2021, which is a continuation of application No. 17/192,662, filed on Mar. 4, 2021, now Pat. No. 11,173,363.

(60) Provisional application No. 63/106,895, filed on Oct. 29, 2020.

(51) Int. Cl.

| | |
|---|---|
| ***A63B 67/06*** | (2006.01) |
| ***A63B 63/08*** | (2006.01) |
| *A47B 91/12* | (2006.01) |

(52) U.S. Cl.
CPC ..... *A63B 67/06* (2013.01); *A63B 63/08* (2013.01); *A47B 91/12* (2013.01)

(58) Field of Classification Search
CPC ..... A63B 63/08; A63B 67/06; A47B 91/12
See application file for complete search history.

(56) References Cited

U.S. PATENT DOCUMENTS

| | | | |
|---|---|---|---|
| 3,126,666 | A | 3/1964 | Petersen |
| 4,645,168 | A | 2/1987 | Beard |
| 5,056,796 | A | 10/1991 | Conville |
| 5,743,506 | A | 4/1998 | Adams |
| 5,823,492 | A | 10/1998 | Anselmo |
| 6,119,998 | A | 9/2000 | Anselmo |

(Continued)

FOREIGN PATENT DOCUMENTS

| | | | |
|---|---|---|---|
| CH | 514314 | A | 10/1971 |
| DE | 2917400 | A1 | 11/1979 |
| DE | 202015101525 | U1 | 4/2015 |

OTHER PUBLICATIONS

English machine translation of CH 514,314 A (Year 1971).

(Continued)

*Primary Examiner* — Laura Davison
(74) *Attorney, Agent, or Firm* — Procopio Cory Hargreaves and Savitch LLP

(57) ABSTRACT

A method of stabilizing a cornhole board on a support surface, comprising providing a cornhole board including an inclined board have a front, a rear, and a top with a target hole, one or more rear supports that support the rear of the inclined board at a height above the front of the board, and one or front supports that support the front of the inclined board; providing one or more stabilizing units for the one or more front supports that support the front of the inclined board and the one or more rear supports that support the rear of the inclined board, wherein the one or more one or more stabilizing units include one or more adhesion members that adhere to and stabilize the cornhole board relative to the support surface.

18 Claims, 11 Drawing Sheets

(56) References Cited

U.S. PATENT DOCUMENTS

| | | | | |
|---|---|---|---|---|
| 6,840,488 | B2 * | 1/2005 | Ngo | A47B 91/12 248/346.11 |
| 8,157,265 | B2 | 4/2012 | Conville | |
| 9,381,414 | B1 | 7/2016 | Gatton | |
| 10,881,205 | B2 | 1/2021 | Angel | |
| 2006/0152345 | A1 | 7/2006 | Aitkenhead | |
| 2012/0252543 | A1 | 10/2012 | Cho | |
| 2014/0091526 | A1 | 4/2014 | Nally | |
| 2015/0108719 | A1 | 4/2015 | Devine | |
| 2016/0183393 | A1 | 6/2016 | Groom | |
| 2017/0224113 | A1 | 8/2017 | Heege | |
| 2019/0232136 | A1 | 8/2019 | Krause | |
| 2020/0129835 | A1 | 4/2020 | Clark | |
| 2020/0298079 | A1 | 9/2020 | Mullins | |

OTHER PUBLICATIONS

English machine translation of DE 2917400 A1 (Year 1979).
English machine translation of DE 20 2015 101 525 U1 (Year 2015).

* cited by examiner

GAME BOARD HOLDER AND METHOD OF USE

FIELD OF THE INVENTION

The present invention relates, in general, to game boards for object tossing games, and, in particular, to holding devices to secure the game boards to an underlying surface.

BACKGROUND OF THE INVENTION

For game boards of object tossing games (e.g., cornhole, bag toss) where an object is tossed at a target (e.g., flat surface with one or more holes for the object to fall through), it is commonplace for the board to move when struck with the tossed object. Movement of the game board forwards, backwards, and/or side-to-side caused by the tossed object striking the game board is a problem, especially in both professional and competitive recreational cornhole games where movement of the game board can mean the difference between winning and losing a game/match and it is time consuming and frustrating for players (and embarrassing for television coverage) to have to stop play (e.g., multiple times during a given match) to move the boards back into regulation position. Past attempts to prevent the board from moving include greatly increasing the weight of the boards so they do not move around, placing various types of rubber or plastic feet on the legs of the board to increase friction, placing a shock absorbing material under the feet of the board to reduce bounce, and the use of matts, rugs, and artificial turf.

A disadvantage of adding weight to the board is problem of making the board too heavy. Game boards are already heavy, and the boards are commonly transported to the area where the games will be played. This makes adding weight to the boards a less than ideal solution.

Non-adhesive rubber boots, feet, or sleeves for the base of the cornhole boards have a marginal effect. This approach may assist a little with the amount of movement, but it is minimal, and the movement is still a major issue. With 2 pounds of force from the cornhole bag impacting the board at 27 feet and at an average height of 8 feet, the pressure/force moves the board significantly.

The disadvantages of adding shock absorbing material, beneath the feet of the board, is that upon impact of the tossed object the board absorbs energy usually in the form of the board flexing, or flexing at the leg joint. The energy is then released as the board or legs pop back into place. This event often causes the board to lose contact with the ground, which renders any object fastened to the end of the legs useless, as there is no surface for them to hold on to. Further, the shock absorbing pads do not mitigate the lateral force generated by the impact of the object, and therefore still allow movement of the board to move around, just at a reduced amount.

National, Conference, and Regional events can have as many as 100 sets (200) boards. Utilizing mats or rugs is not an efficient method. Bringing 200-400 matts is not only cumbersome due to size and weight, but the cost is exorbitant.

Another problem that occurs in cornhole is that the boards are not level when playing on uneven surfaces. Cornhole should be played on a flat surface without a degree of uneven slant caused by the surface of the ground. For example, if a board is tilting to the right at 1-2 degrees, this creates a disadvantage for the player, who must adjust one's throw to the slant in the board.

Another problem that occurs in cornhole is that many event centers, gymnasium, and ballrooms will not allow cornhole to be played at their venues due to the damage the feet of a cornhole board can do to the flooring material. The event space may also require/charge the tournament for an overlay of some protective material for the entire floor. This is very costly and labor intensive. In many cases, the tournament may need to be moved to a venue that is not concerned about their flooring. Further, as discussed above, utilizing mats or rugs is not an efficient method.

SUMMARY OF THE INVENTION

An aspect of the invention involves one or more game board holders keeps the game board in place during play using one or more securement devices such as, but not limited to, corner brackets/securement devices, front bracket(s)/securement device(s), and/or rear bracket(s)/securement device(s). The brackets allow for multiple means (e.g., adhesion, stakes) of anchoring to accommodate almost any surface. In addition to keeping the game board in place, the corner brackets also has the ability to compensate for play areas that are not level, by attaching snap in leveling blocks or shims. When using adhesion to anchor the board to a surface, the weight of the board aids with the adhesion.

An aspect of the invention involves a method of stabilizing a cornhole board on a support surface, comprising providing a cornhole board including an inclined board have a front, a rear, and a top with a target hole therein, one or more rear supports that support the rear of the inclined board at a height above the front of the board, and one or more front supports that support the front of the inclined board; providing one or more stabilizing units for the one or more front supports that support the front of the inclined board and the one or more rear supports that support the rear of the inclined board, the one or more stabilizing units for the one or more front supports and the one or more rear supports including one or more adhesion members; adhering the one or more adhesion members of the one or more stabilizing units to the support surface to stabilize the cornhole board relative to the support surface.

One or more implementations of the aspect of the invention described immediately above includes one or more of the following: the one or more adhesion members include one or more stick gel members, and adhering the one or more adhesion members includes adhering the one or more stick gel members to the support surface; removing one or more covers from the one or more stick gel members prior to adhering the one or more stick gel members to the support surface; detaching the one or more stick gel members from the support surface; reactivating the one or more stick gel members with water when the one or more stick gel members lose ability to stick; the one or more front supports and the one or more rear supports carry the one or more adhesion members; the one or more rear supports that support the rear of the inclined board and the one or front supports that support the front of the inclined board include four support corners and the one or more stabilizing units for the one or more front supports and the one or more stabilizing units for the one or more rear supports include four corner brackets that securably receive the four support corners, the four corner brackets include the one or more adhesion members, and the method further comprising receiving the four support corners feet in the four corner brackets, adhering the one or more adhesion members of the four corner brackets to the support surface; adding one or more shims to the one or more of the four corner brackets to compensate for play areas that are not level; adding the one or more shims to the one or more of the four corner brackets includes snapping the shims to the corner bracket and to an underlying shim; and/or the one or more stabilizing units for the one or more front supports and the one or more stabilizing units for the one or more rear supports include at least one of a front bracket and a rear bracket including the one or more adhesion members, and the method further comprising at least one of: receiving by the front bracket the one or more front supports and adhering the one or more adhesion members to the support surface, and receiving by the rear bracket the one or more rear supports and adhering the one or more stick adhesion to the support surface; the stabilizing unit includes a finger handle, and the method further comprises receiving one or more fingers with the finger handle and removing of the stabilizing unit from the support surface via the finger handle.

A further aspect of the invention involves a cornhole board stabilizing unit for stabilizing a cornhole board on a support surface, the cornhole board including a front, a rear, and a top with a target hole therein, one or more rear supports that support the rear of the inclined board at a height above the front of the board, and one or front supports that support the front of the inclined board comprising a base including an upper surface and a lower surface; a bracket extending upward from the upper surface of the base, the bracket configured to receive one of the one or more front supports and the one or more rear supports; one or more adhesion members secured to the lower surface of the base, the one or more adhesion members including a lower surface that is adherable to the support surface to stabilize the cornhole board relative to the support surface.

One or more implementations of the aspect of the invention described immediately above includes one or more of the following: the base is elongated, the one or more front supports include a single front support, and the bracket secures the single front support in position; the base is elongated, the one or more rear supports include a single rear support, and the bracket secures the single rear support in position; one or more rear vertical supports, and the bracket and the one or more rear vertical supports receiving the single front support of the cornhole board there between; one or more spacers configured to be received by the one or more vertical supports to accommodate single front supports of varying thickness; a removable advertising insert that is removably insertable with respect to the bracket; the one or more adhesion members include one or more stick gel members and one or more covers to cover the one or more stick gel members; the one or more front supports and the one or more rear supports include four corners, and the cornhole board stabilizing unit includes an angled bracket that receives one of the four corners to secure the corner in position; the base includes one or more holes to receive one or more anchors to anchor the cornhole board stabilizing unit to turf; an undersurface with anchors to anchor the cornhole board stabilizing unit to artificial turf; a removable advertising insert that is removably insertable with respect to the bracket; one or more leveling blocks to compensate for play areas that are not level; the one or more leveling blocks are multiple snap-in leveling blocks that snap into the base and to each other; and/or a finger handle to grab the cornhole board stabilizing unit with one or more fingers and remove the cornhole board stabilizing unit from the support surface.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
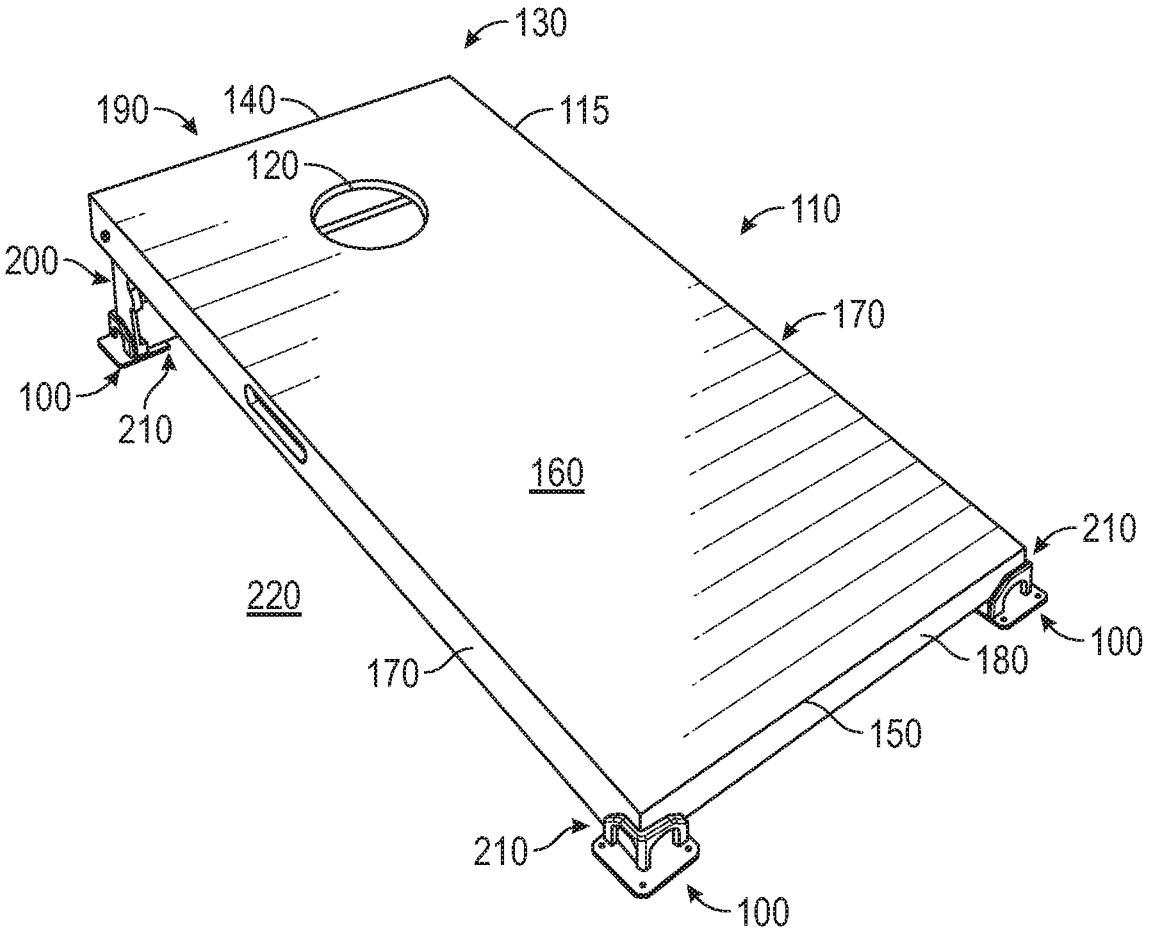
FIG. 1 is a front perspective view of a cornhole board using a plurality of game board holders in accordance with an embodiment of the invention.
Figure 2A:
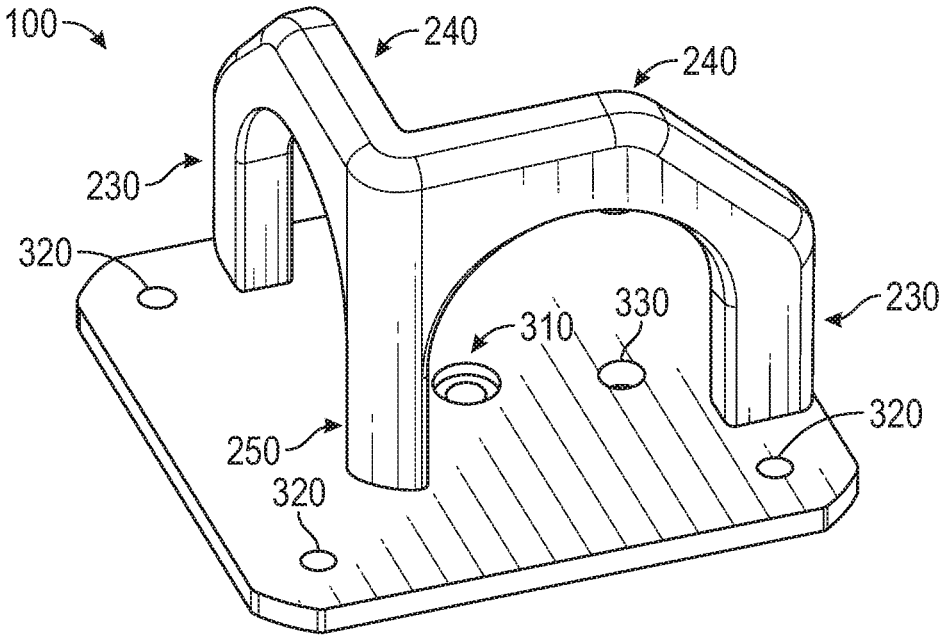
FIGS. 2A and 2B are perspective and top plan views of one of the game board holders shown in FIG. 1.
Figure 2B:
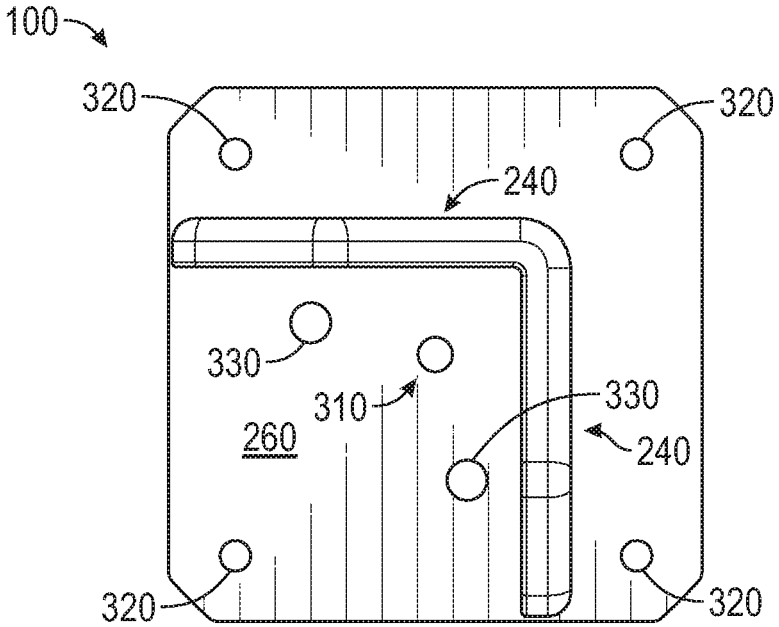
Figure 3:
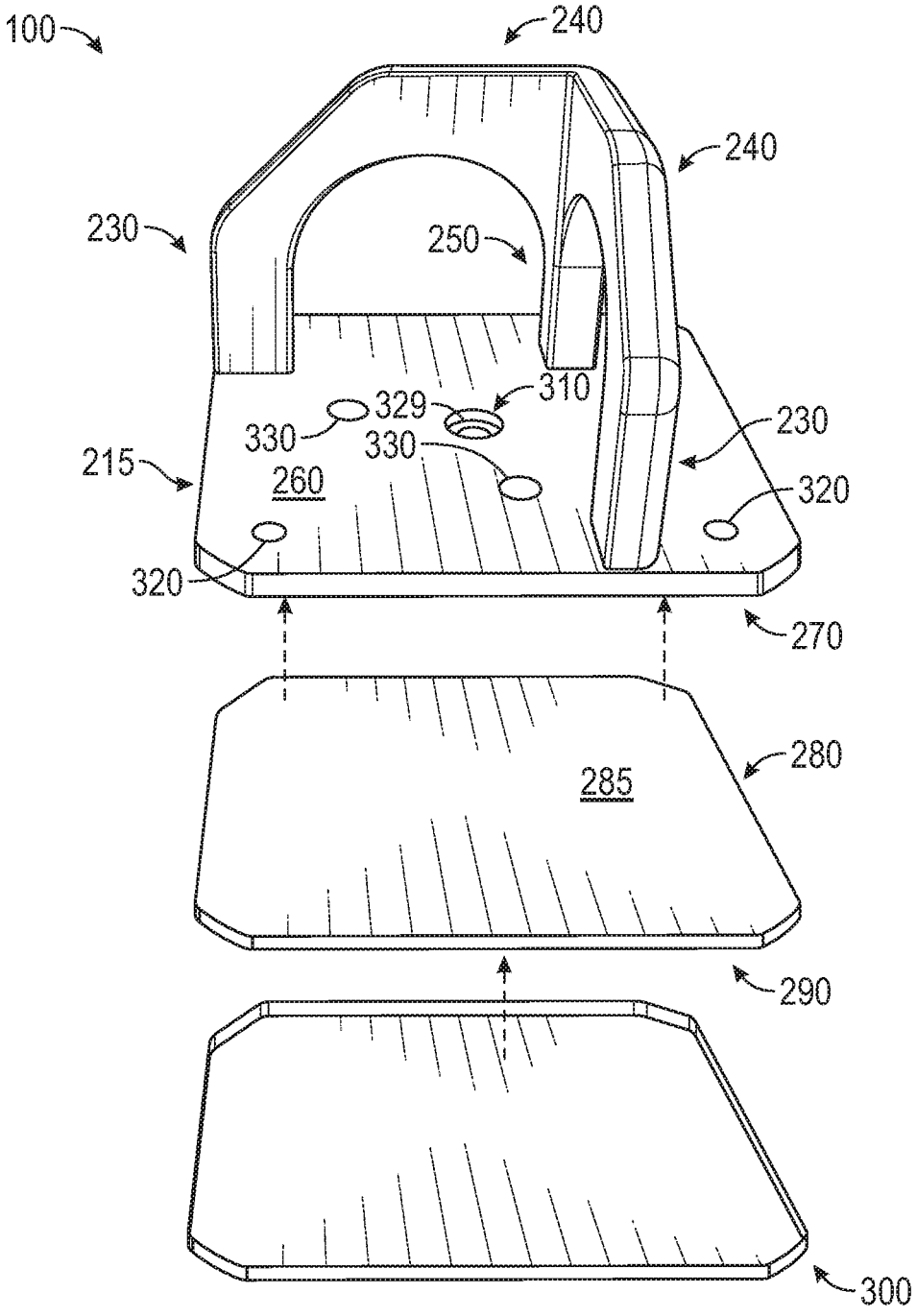
FIG. 3 is an exploded perspective view of one of the game board holders shown in FIG. 1.
Figure 4:
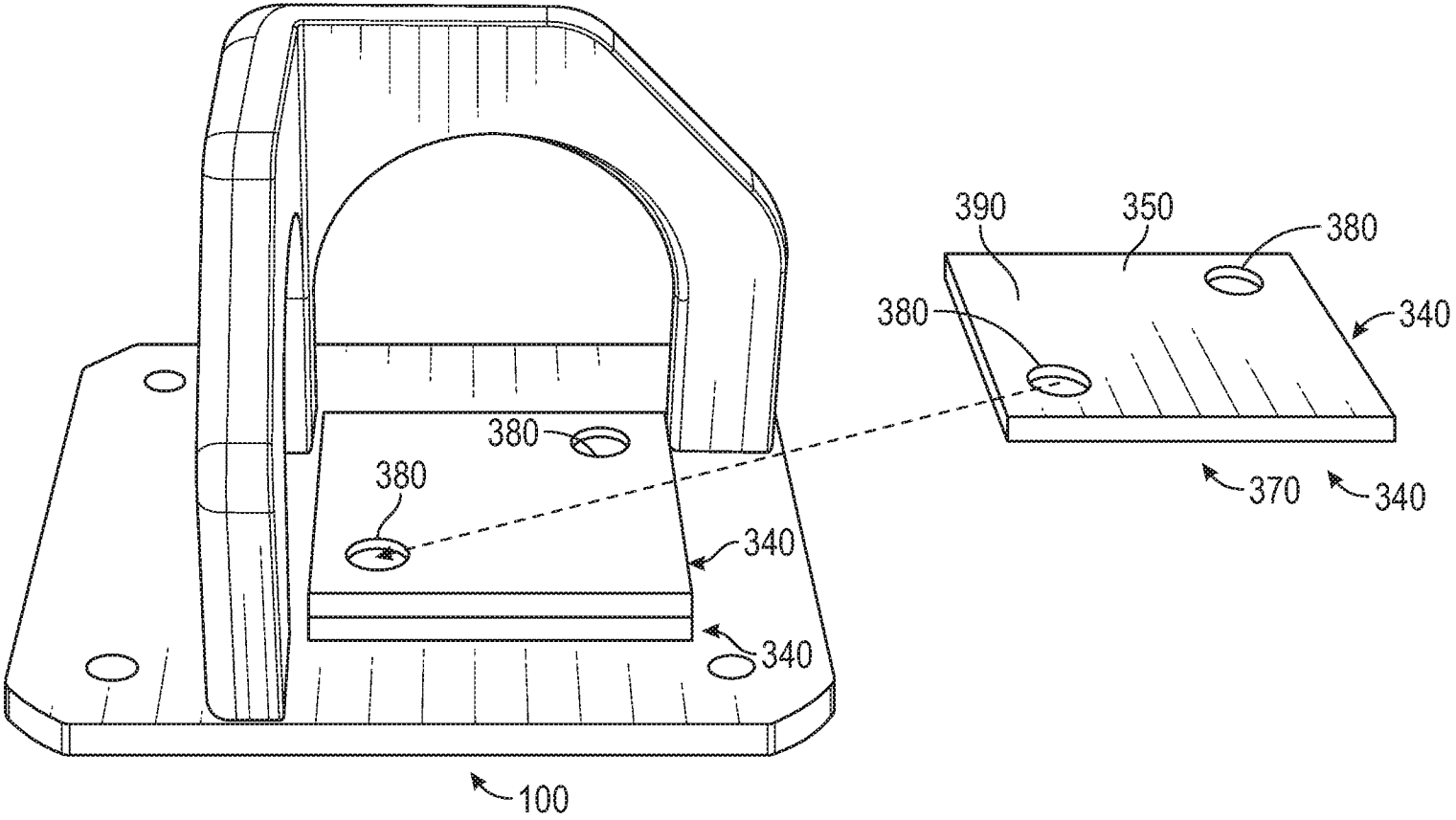
FIG. 4 is a front perspective view of the game board holder shown in FIGS. 1-3, and illustrates leveling blocks or shims that snap-into the game board holder, other leveling blocks/shims to compensate for play areas that are not level.
Figure 5:
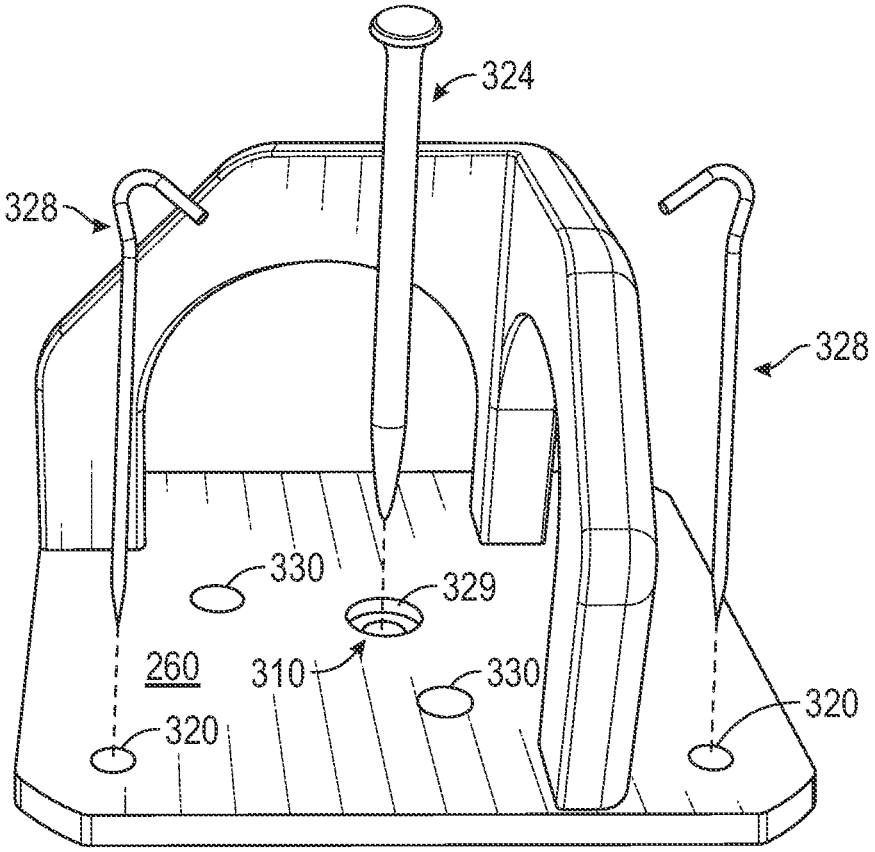
FIG. 5 is a perspective view of the game board holder of FIGS. 1-3, and shows alternative anchors for the game board holder/cornhole board.

With reference to FIGS. 1-5, an embodiment of a game board holder or game board stabilizing member 100 for a cornhole board 110 and method of using the game board holder will be described after first describing cornhole and a cornhole board.

Cornhole (also known as bags, sack toss, or bean bag toss) is a game in which players take turns throwing weighted bags (e.g., traditionally of corn kernels) at a raised platform/board 115, which includes a target hole 120 in a top/far/rear end 130. A cornhole board 110 is 2 by 4 feet (0.61 by 1.22 m) with a 6-inch (150 mm) hole centered 9 inches (230 mm) from the rear end 130. The board 110 is angled with a top/far/rear edge 140 of the playing surface 12 inches (300 mm) above the ground, and a bottom/near/front edge 150 3-4 inches (76-102 mm) above the ground. The board 110 includes a top surface 160, opposite side surfaces 170, a front surface/support 180, a rear surface 190, and a pair of rear legs or rear support 200. The bottom of the pair of rear legs 200 and the bottom of the front surface 180 of the board 110 form four corner feet 210 that support the board 110 on a support surface (e.g., floor, turf) 220.

Four game board holders/corner brackets/securement devices 100 receive the four corner feet 210 of the board 110 to keep the game board 110 in place during play. The game board holders 100 are preferably made of polypropylene or related plastics, but in alternative embodiments, may be made of metal, steel, or other strong materials the adhesive gel technology may stick to. Each game board holder 100 includes a flat substantially rectangular base 215 and a plurality of vertical supports 230 that are interconnected by lateral supports/rails 240 that join together at a 90 degree angle at a corner vertical support 250 that together form a bracket. The supports 230, 240, 250 and a top 260 of the base 215 receive the corner feet 210 of the board 110. An underside 270 of the game board holder 100 includes an anti-slip/skid adhesion member (e.g., double-sided/double rubber gel pad/member) 280 with a top side 285 that adheres to the underside 270 of the game board holder 100 and a bottom side 290 that adheres to the support surface 220 to secure the game board holders 100, and, hence, the board 110 in position. The adhesion/gel member 280 is a sticky silicone gel pad made of pure PU material and provide extreme adhesion, super sticky effect. When the adhesion/gel member's viscidity is weakened by dust, it is rinsed with water and, after air drying, the stickiness is restored. A removable cover 300 is used to cover the underside 270 of the game board holder 100 when the game board holder 100 is not in use.

The base 215 includes a central recessed anchor hole 310 and one or more additional anchor holes 320 that receive one or more nails 324, light tent stakes 328, or other anchors to secure the game board holder 100 to dirt, grass. The recessed anchor hole 310 includes a recessed opening 329 so that a nail head does not interfere with leveling blocks 340.

The base 215 further includes one or more anchor holes 330 for receiving snap-in leveling blocks/shims 340. The snap-in leveling blocks 340 are flat rectangular plates 350 with snap-in protrusions on an underside 370 and recessed holes 380 on an upper side 390. The snap-in protrusions of an upper leveling block 340 snap into the recessed holes 380 of a lower leveling block 340, and the snap-in protrusions of the lowest leveling block 340 snap into the anchor holes 330 of the base 215 in order to stackably secure the leveling blocks 340 to the game board holder 100 to compensate for play areas that are not level.

Figure 6:
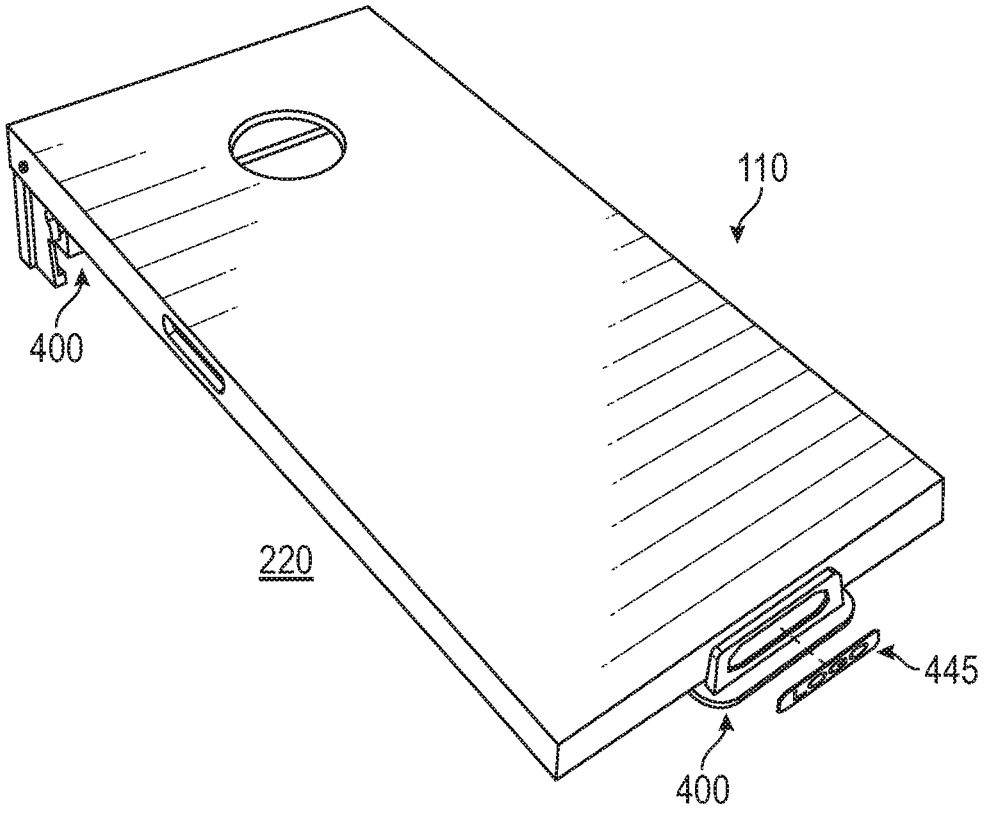
FIG. 6 is a front perspective view of a cornhole board using a pair of game board holders in accordance with another embodiment of the invention.

FIG. 6 illustrates the cornhole board 110 secured to the support surface (e.g., floor, turf) 220 using a pair of game board holders game board holders/brackets/securement devices 400 in accordance with another embodiment of the invention.

Figure 7:
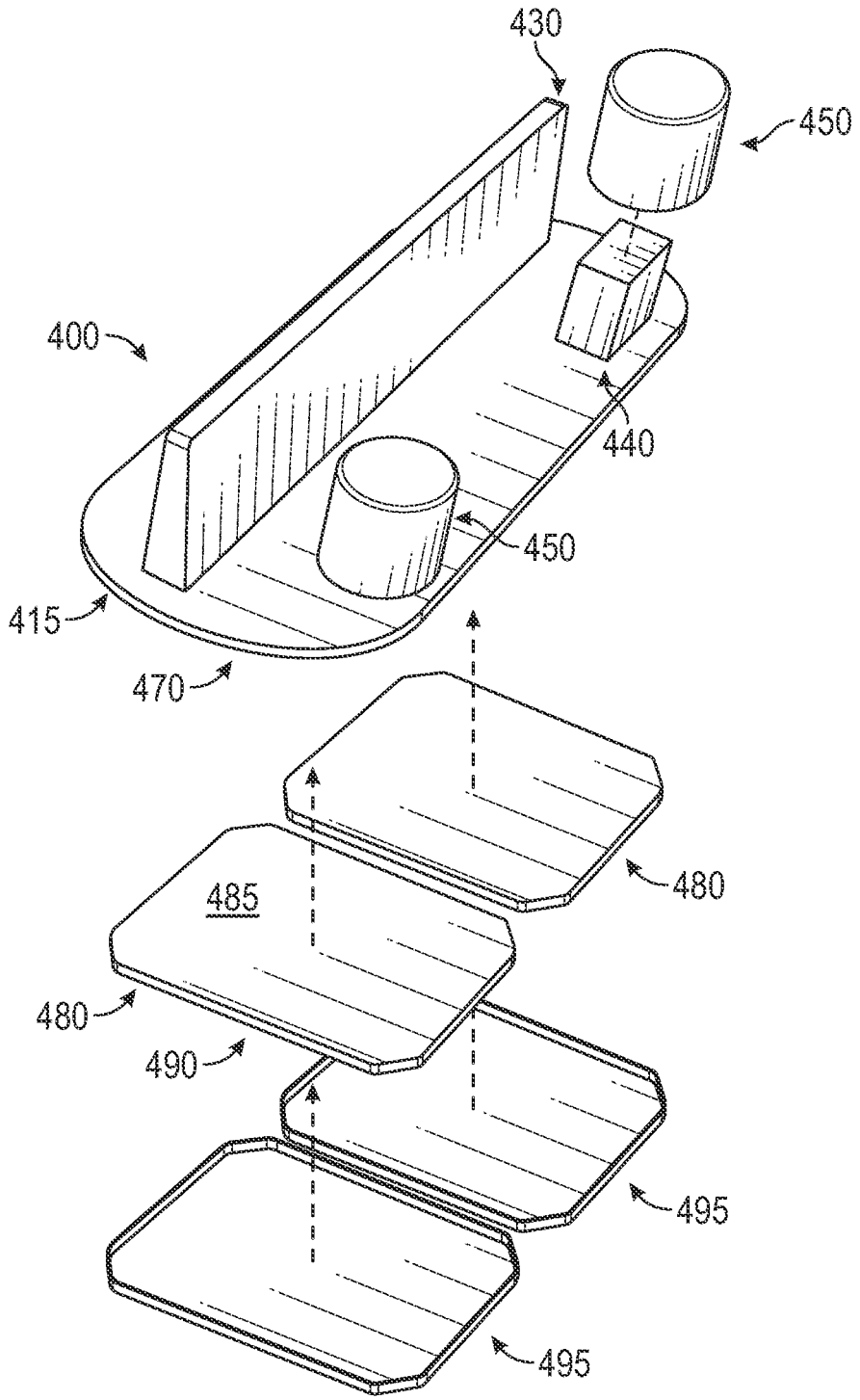
FIG. 7 is a rear exploded perspective view of one of the game board holders illustrated in FIG. 6.

With reference additionally to FIG. 7, each game board holder 400 is preferably made of polypropylene or related plastics, but in alternative embodiments, may be made of metal, steel, or other strong materials the adhesive gel technology may stick to. Each game board holder 400 includes a flat substantially elongated base 415 and an elongated front rail support 430 that form a bracket, and one or more rear vertical supports 440. The game board holder may include a removable graphics/advertising member/insert 445 that is removably insertable with respect to elongated front rail support 430, and allows for branding (e.g., white labeling/external branding) of the product where inserts or stickers can be used to promote brands. The front surface/support 180 and the rear support(s) 200 of the cornhole board 110 are received and secured between the elongated front rail support 430 and the rear vertical support(s) 440, as shown in FIG. 6. The rear vertical support(s) 440 includes one or more (or one or more sets) of removable elastic spacer(s) 450 that removably mount onto/off of the rear vertical support(s) 440 to accommodate and secure the front surface/support 180 and the rear support(s) 200 of the cornhole board 110 between the elongated front rail support 430 and the rear vertical support(s) 440. An underside 470 of the game board holder 400 includes one or more adhesion members (e.g., double-sided/double rubber gel pad/members) 480 with a top side 485 that adheres to the underside 470 of the game board holder 400 and a bottom side 490 that adheres to the support surface 220 to secure the game board holders 400, and, hence, the board 110 in position. One or more removable covers 495 are used to cover the underside 470 of the game board holder 400 when the game board holder 400 is not in use.

Figure 8:
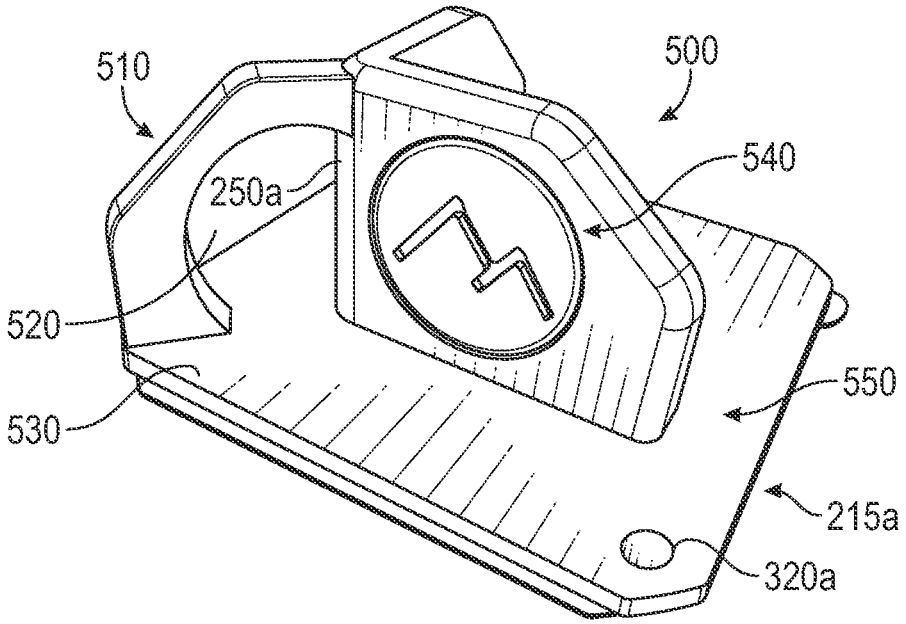
FIG. 8 is a perspective view of another embodiment of a game board holder.
Figure 9:
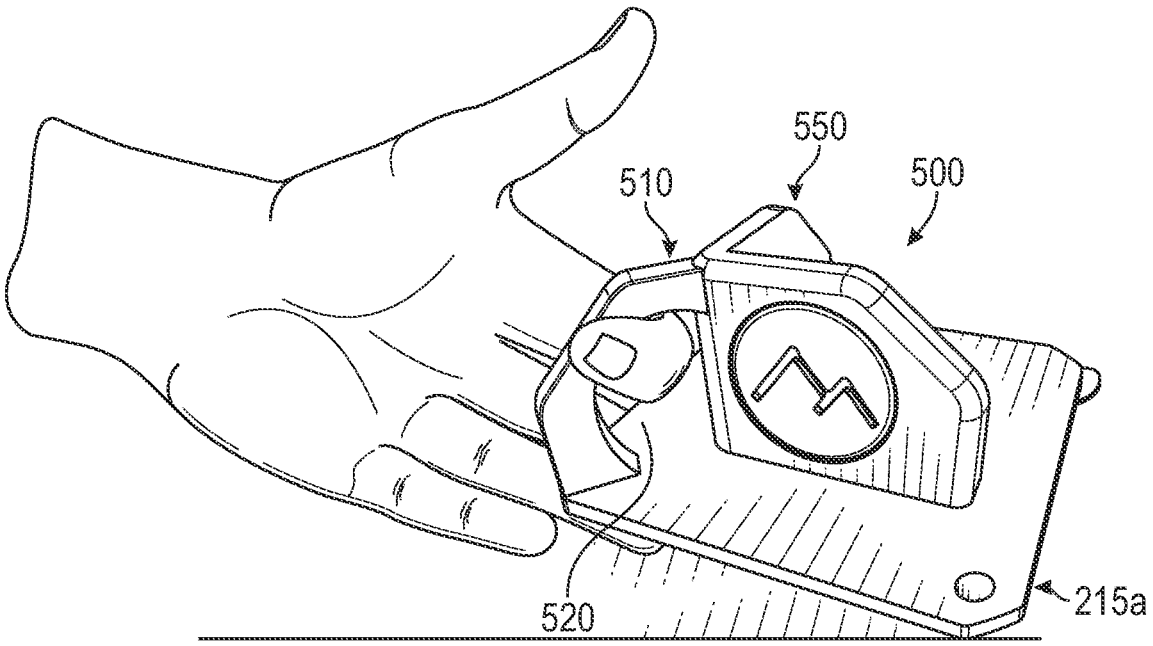
FIG. 9 is a top perspective view of the game board holder of FIG. 8, and shows how the game board holder is removed from a support surface.
Figure 10:
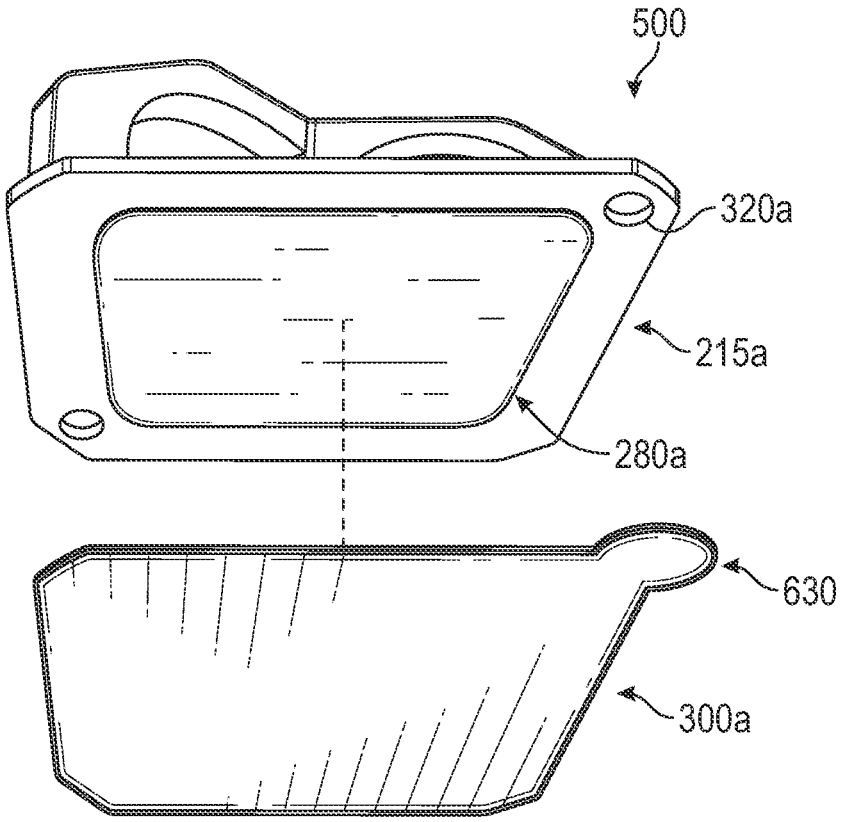
FIG. 10 is a bottom perspective view of the game board holder of FIG. 8.

FIGS. 8-10 illustrate another embodiment of a game board holder game/bracket/securement device 500, which is similar to the game board holder 100, but with a few differences enumerated below. Like elements to the game board holder 100 may be shown with the same reference number, but with an "a" suffix. The above description of the game board holder 100 is incorporated herein. The game board holder 500 includes a finger handle 510 and finger hole 520 that receives one or more fingers as shown in FIG. 9 to facilitate, via the finger handle 510, the pulling/removing of the game board holder 500 secured to the support surface 220 from the support surface 220. The finger handle 510 extends from the corner vertical support **250*a* to a rear corner 530 of the base 215*a*. A removable graphics/advertising member/insert 540 is removably insertable with respect to corner bracket 550**, and allows for branding (e.g., white labeling/external branding) of the product where inserts or stickers can be used to promote brands.

The game board holder 500 does not include the central recessed anchor hole 310, but does have a single anchor hole similar to and instead of a pair of anchor holes 330.

Figure 11:
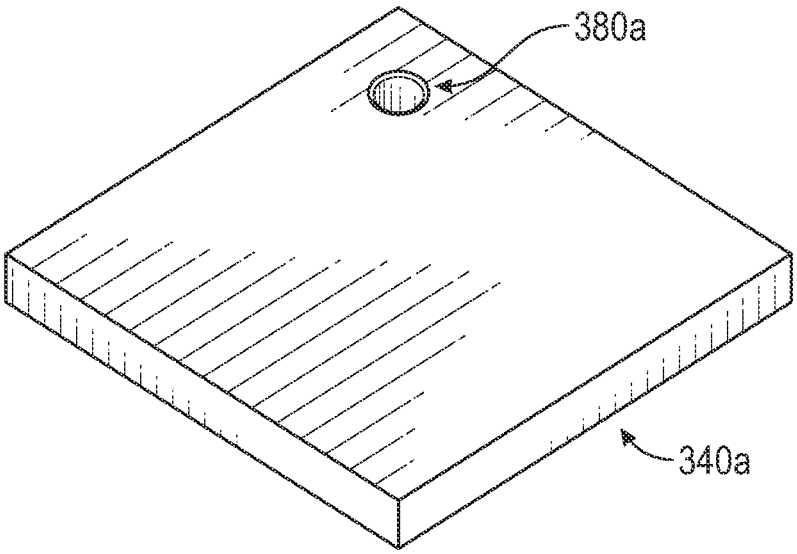
FIG. 11 is a top perspective view of a snap-in leveling block or shim of the game board holder of FIG. 8.
Figure 12:
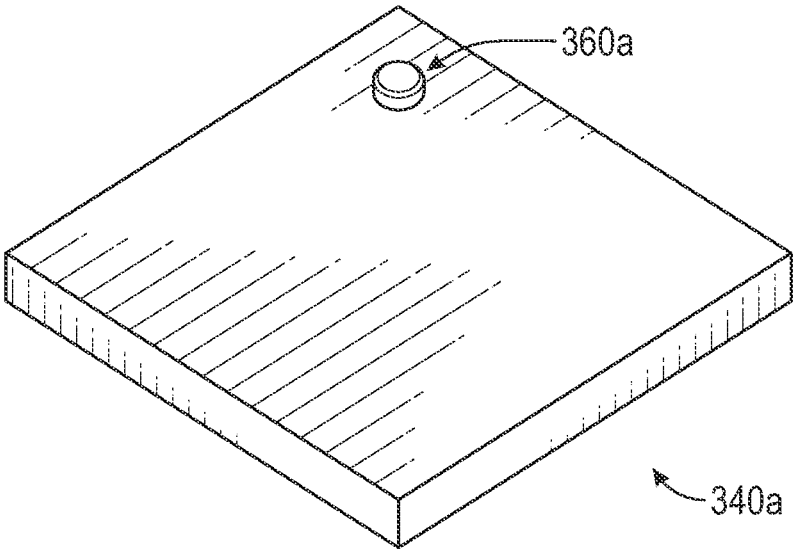
FIG. 12 is a bottom perspective view of the snap-in leveling block or shim of FIG. 11.

As shown in FIGS. 11 and 12, the game board holder 500 may receive one or more leveling blocks **340*a* to compensate for play areas that are not level. The leveling blocks 340*a* are similar to the leveling blocks 340 shown and described above, but include a single recessed hole 380*a* and a single snap-in protrusion 360*a***.

Figure 13:
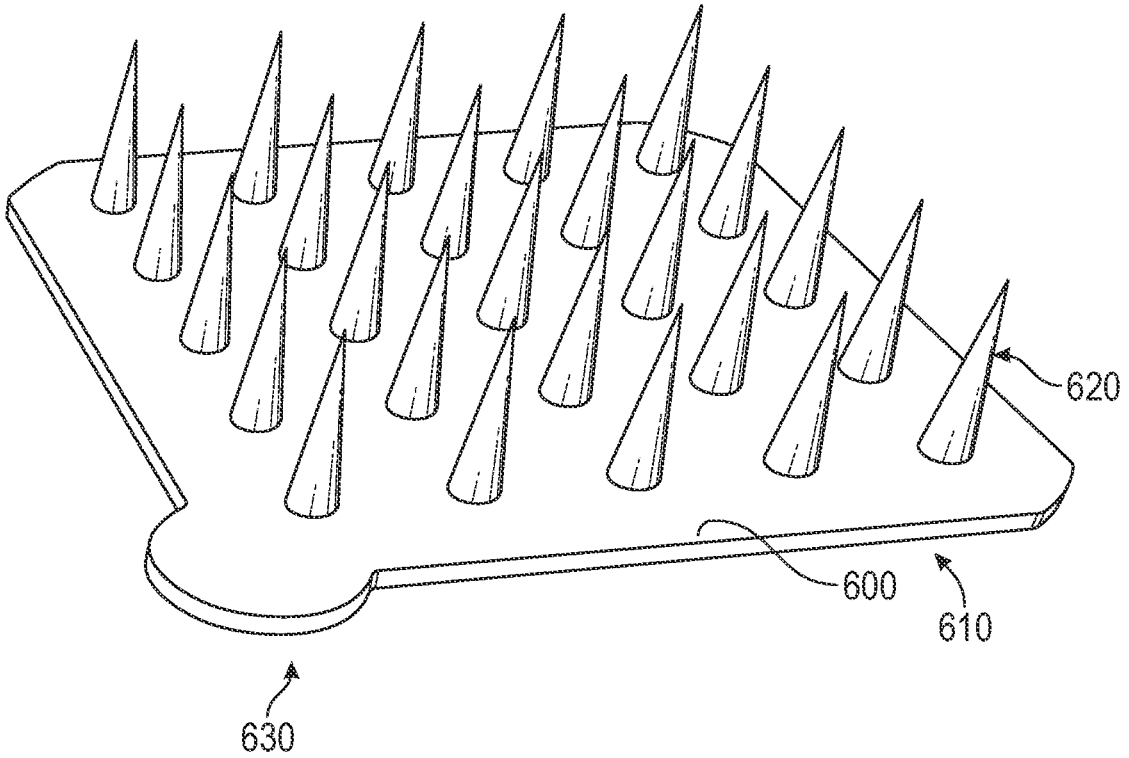
FIG. 13 is a perspective view of an alternative underside of a game board holder to secure the game board holder to a support surface such as carpet and/or artificial turf.

With reference to FIG. 13, an alternative underside 600 of a securement member 610 and/or game board holder 100, 400, 500 includes a plurality of cones/spikes/hooks/anchors 620 to secure the game board holder 100, 400, 500 to a support surface such as carpet and/or artificial turf. A corner tab 630 may be provided on the member 610 and/or the covers 300, **300*a* to facilitate grabbing the member 610 and/or covers 300, 300*a***.

Accordingly, the game board holder 100 can be secured to the support surface 220 (e.g., floor, turf) by adhesion, cones, spikes, hooks, anchors to accommodate almost any surface. In addition to keeping the game board 110 in place, the game board holders 100, 400, 500 have the ability to compensate for play areas that are not level by attaching/adding the snap-in leveling blocks or shims 340, **340*a*. When using adhesion to anchor the board 110 to the support surface 220 (e.g., floor), the weight of the board 110 aids with the adhesion. The game board holder 100 prevents the cornhole board 110 from moving. The game board holder 100, 400, 500 allows the board 110 to stay at a desired distance without the board sliding backwards, forwards, or side to side. The adhesive technology (e.g., adhesive double-sided stick gel member) adheres to the support surface 220 to secure the game board holders 100, and, hence, the board 110 in position. The removable cover(s) 300, 495 is/are removed from the adhesive double-sided stick gel member before adhering the double-sided stick gel member 480 to the support surface 220. After use, the adhesive double-sided stick gel member 280, 480 is rinsed with water and the removable cover 300, 495 is adhered back onto the adhesive double-sided stick gel member 280, 480. The adhesive of the double-sided stick gel member 280, 480** enables the board 100 to stick to, but not limited to, concrete, asphalt, tile, carpet, wood, linoleum, gymnasium flooring, matts, rugs, etc.

The game board holder 100, 400, 500 is portable, removable, universal, and reusable. In alternative embodiments, the game board holder 100, 400, 500 and/or the adhesive gel member 280, 480 is removable, portable, and/or permanently attached to the boards 110. The game board holder 100 uses the nail(s) 324 and/or stakes 328 for anchoring the game board holder 100 to the grass. Once the adhesive gel pad 280, 480 becomes dirty and begins to lose it stickiness/adhesive qualities, the adhesive gel pad 280, 480 is simply cleaned by running warm water on the adhesive gel pad 280, 480, returning it to its original stickiness. The game board holder 100 allows the boards 110 to be leveled utilizing shims 340, which are removably secured in the game board holder 100, 400, 500, which prevents the board 110 from moving. The shims 340 snap together to increase the desired height of the unleveled board 110. The adhesive gel pads 280, 480 also provide a buffer between the floor and board 110, negating the need for mats, rugs or expensive protective coatings or covers. The game board holder 100, 400, 500 not only stops the cornhole board 110 from moving, but it levels the board 110 and protects the flooring or surface 220 whether the game is played indoors or outdoors. The game board holder 100, 400, 500 also does not leave any residue on the flooring 220 when removed, which is especially important for rented facilities used at the professional level. The game board holder 100, 400, 500 allows for branding (e.g., white labeling/external branding) of the product where inserts or stickers can be used to promote brands.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A method of stabilizing a cornhole board on a support surface, comprising:

providing a cornhole board including an inclined board have a front, a rear, and a top with a target hole therein, one or more rear supports that support the rear of the inclined board at a height above the front of the board, and one or more front supports that support the front of the inclined board, the one or more rear supports that support the rear of the inclined board and the one or more front supports that support the front of the inclined board include four support corners;

providing one or more stabilizing units for at least one of the one or more front supports that support the front of the inclined board and the one or more rear supports that support the rear of the inclined board, the four corner brackets each including a bottom adhering one or more adhesion members to the bottom of each of the four corner brackets;

receiving the four support corners by the four corner brackets;

adhering the one or more adhesion members of each of the four corner brackets to the support surface; and stabilizing the cornhole board relative to the support surface with the one or more adhesion members of each of the four corner brackets.

2. The method of claim 1, wherein the four corner brackets each include a base with an edge, and the method further comprising removing the adhered four corner brackets from the support surface by each of pulling up on the four corner brackets adjacent to the edge of the base of each of the four corner brackets.

3. A method of stabilizing a cornhole board on a support surface, the cornhole board including an inclined board have a front, a rear, and a top with a target hole therein, one or more rear supports that support the rear of the inclined board at a height above the front of the board, and one or more front supports that support the front of the inclined board, the one or more rear supports that support the rear of the inclined board and the one or more front supports that support the front of the inclined board include four support corners, comprising:

providing four corner brackets that securably receive the four support corners of the one or more front supports that support the front of the inclined board and the one or more rear supports that support the rear of the inclined board, each of the four corner brackets including a bottom adhering one or more adhesion members to the bottom of each of the four corner brackets;

receiving the four support corners by the four corner brackets;

adhering the one or more adhesion members of each of the four corner brackets to the support surface;

stabilizing the cornhole board relative to the support surface with the one or more adhesion members of each of the four corner brackets.

4. A method of stabilizing a cornhole board on a support surface, the cornhole board including an inclined board have a front, a rear, and a top with a target hole therein, one or more rear supports that support the rear of the inclined board at a height above the front of the board, and one or more front supports that support the front of the inclined board, the one or more rear supports that support the rear of the inclined board and the one or more front supports that support the front of the inclined board include four support corners, comprising:

providing four corner brackets that securably receive the four support corners of the one or more front supports that support the front of the inclined board and the one or more rear supports that support the rear of the inclined board, each of the four corner brackets including a bottom providing one or more adhesion members for the bottom of each of the four corner brackets;

receiving the four support corners by the four corner brackets;

whereby the one or more adhesion members for each of the four corner brackets are configured to be adhered to the support surface and stabilize the cornhole board relative to the support surface.

5. The method of claim 4, wherein the one or more adhesion members include one or more stick gel members, and the method further comprises adhering the one or more stick gel members to the bottom of each of the four corner brackets, and adhering the one or more one or more stick gel members to the support surface.

6. The method of claim 5, further including removing one or more covers from the one or more stick gel members prior to adhering the one or more stick gel members to the support surface.

7. The method of claim 5, further including detaching the one or more stick gel members from the support surface.

8. The method of claim 7, further including reactivating the one or more stick gel members with water when the one or more stick gel members lose ability to stick.

9. The method of claim 5, wherein the one or more adhesion members includes a grab tab and further comprising grabbing the grab tab to remove the one or more adhesion members from at least one of the four corner brackets and the support surface.

10. The method of claim 5, wherein the four corner brackets each include a finger handle, and the method further comprises receiving one or more fingers with the finger handle and removing each of the four corner brackets from the support surface via the finger handle.

11. The method of claim 4, wherein the bottom of each of the four corner brackets is flat.

12. The method of claim 4, further comprising adding one or more shims, which are different from the four corner brackets, within the four corner brackets to compensate for play areas that are not level.

13. The method of claim 12, wherein adding the one or more shims includes snapping the one or more shims to at least one of the four corner brackets and to an underlying shim.

14. The method of claim 4, wherein the four corner brackets each include a removable advertising insert that is removably insertable with respect to the four corner brackets.

15. The method of claim 4, wherein the four corner brackets each include a 90 degree angle bracket that receives one of the four support corners.

16. The method of claim 4, wherein the four corner brackets each include one or more holes to receive one or more anchors to anchor the four corner brackets to turf.

17. The method of claim 4, wherein the four corner brackets each include an undersurface with anchors to anchor the four corner brackets to artificial turf.

18. The method of claim 4, wherein the one or more adhesion members are removable.

* * * * *